US008387801B2

(12) United States Patent
Gustafsson

(10) Patent No.: US 8,387,801 B2
(45) Date of Patent: Mar. 5, 2013

(54) COLLECTOR FOR FLOTATION OF CLAY MINERALS FROM POTASH ORES

(75) Inventor: Jan Olof Gustafsson, Kungälv (SE)

(73) Assignee: Akzo Nobel N.V., Arnhem (NL)

( * ) Notice: Subject to any disclaimer, the term of this patent is extended or adjusted under 35 U.S.C. 154(b) by 722 days.

(21) Appl. No.: 12/663,883

(22) PCT Filed: Jun. 10, 2008

(86) PCT No.: PCT/EP2008/057214

§ 371 (c)(1),
(2), (4) Date: Dec. 10, 2009

(87) PCT Pub. No.: WO2008/152029

PCT Pub. Date: Dec. 18, 2008

(65) Prior Publication Data

US 2010/0181233 A1 Jul. 22, 2010

Related U.S. Application Data

(60) Provisional application No. 60/934,305, filed on Jun. 12, 2007.

(30) Foreign Application Priority Data

Jul. 5, 2007 (EP) ..... 07013198

(51) Int. Cl.
*B03D 1/01* (2006.01)
*B03D 1/02* (2006.01)

(52) U.S. Cl. ..... 209/166

(58) Field of Classification Search ..... 209/166
See application file for complete search history.

(56) References Cited

U.S. PATENT DOCUMENTS

| | | | | |
|---|---|---|---|---|
| 3,805,951 | A | 4/1974 | Brogoitti et al. | |
| 4,192,737 | A | 3/1980 | Thompson et al. | |
| 4,198,288 | A * | 4/1980 | Levine et al. | 209/5 |
| 4,608,154 | A * | 8/1986 | Chan et al. | 209/166 |

FOREIGN PATENT DOCUMENTS

| | | |
|---|---|---|
| GB | 953550 | 3/1964 |
| GB | 2 125 058 A | 2/1984 |
| RU | 2 237 521 C1 | 10/2004 |
| SU | 839575 A1 | 6/1981 |
| SU | 925397 A1 | 5/1982 |
| SU | 1304893 A1 | 4/1987 |

OTHER PUBLICATIONS

Shubov L. Ja., et al., "Flotation reagents in process for enrichment of mineral raw Materials. Book 1", Moscow, Nedra, 1990, p. 27-34. English-language translation provided pp. 1-6.
English lanuage machine translation of Russian Patent Publication No. RU 2278739.
International Search Report for International Application No. PCT/EP2008/057214, Sep. 11, 2008.
European Search Report for European Application No. 07013198.2, Apr. 10, 2008.
Thomson Reuters Abstract No. 2004-792554 for Russian Patent Publication No. 2237521C1.
Thomson Reuters Abstract No. 1987-340564 for U.S.S.R. Patent Publication No. 1304893A1.

* cited by examiner

*Primary Examiner* — Thomas M Lithgow
(74) *Attorney, Agent, or Firm* — Norris McLaughlin & Marcus, P.A.

(57) ABSTRACT

The invention relates to a flotation process for removal of slimes from potash ores wherein a collector is used selected from the group of ethoxylated fatty amines having the formulae (formula I) wherein R1 and R2 are, independently, a hydrocarbyl group having 1-22 C-atoms, and n is on average above 15 and less than 100, and (formula II) wherein R3 is a hydrocarbyl group having 8-22 carbon atoms; z is a number 1-3; X, Y and Y' are, independently, an alkyl group with 1-4 carbon atoms or the group $-(EO)_sH$, wherein EO is an ethyleneoxy unit and s is on average 5-50, and the sum of all s is on average 15 or more, and less than 100; provided that at least one of X, Y and Y' is a group $-(EO)_sH$. The invention further relates to a process wherein the step of flotation of slime is followed by a step of flotation of KCl using a different type of collector.

(I)

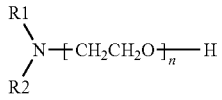

(II)

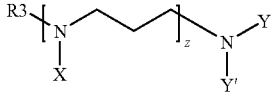

17 Claims, No Drawings

COLLECTOR FOR FLOTATION OF CLAY MINERALS FROM POTASH ORES

The present invention relates to a process to remove clay slimes from potash ores by flotation of at least part of said slimes, using one or more specific ethoxylated secondary fatty amines or fatty polypropyleneamines as collectors.

Potash ore froth flotation is a conventional process for recovering sylvite (KCl) from ore pulps. Examples of potash ores are sylvinite, carnallite, langbeinite, and kainite, and of these sylvinite is easiest to process.

Common gangue minerals in addition to halite (NaCl) are different types of water insoluble fine-grained minerals, such as clay minerals, anhydrite, iron oxides etc, often called slime. The siliceous gangue (clay) consists of very fine particles and represents a large surface area, which adversely affects the recovery of sylvite (KCl) in the potash ore froth flotation process. The collector used during the potash flotation typically adsorbs to the clay, which results in high collector consumption and poor metallurgical results. The clay also interferes with other sylvite beneficiation processes such as dissolution procedures.

Several technical developments have addressed the problems arising from the presence of slime. Mechanical methods such as use of hydro cyclones, centrifuges, hydro separators, etc. are unselective and result in losses of fine particle sylvite. Several patents describe a process where clay-containing sylvinite ores are deslimed by a selective flocculation of slime (clay) followed by froth flotation of the slime. Polyacrylamides are mainly used as flocculants, and several compounds are suggested as collectors. Examples of collectors disclosed in the literature are oxyethylated primary amines (U.S. Pat. No. 3,805,951 and RU 2278739), mixtures of non-ionic and anionic collectors (U.S. Pat. No. 4,192,737), oxyethylated fatty acids (SU1304893), and oxyethylated alkyl phenol (RU2237521).

U.S. Pat. No. 3,805,951 describes a process for desliming sylvinite ores by selective flocculation, followed by froth flotation of the slime. The process includes treatment of the ore pulp with a high molecular weight acrylamide polymer to flocculate the slime and then with a cationic collector that is for example a condensation product of 1 to 10 moles of ethylene oxide with one mole of a C12-C18 primary or secondary aliphatic amine.

RU 2278739 describes a method for enrichment of potassium ores which comprises disintegrating the ore, removing water-insoluble clay-carbonate impurities by formation of a flotation slurry, followed by flotation of potassium chloride. The compounds used for flotation slurry formation are oxyethylated primary amines with 15-50 ethoxy groups per mole of amine.

However, there is still a need for more effective collecting agents for desliming potash ores which do not have a negative effect on the recovery of potassium.

Now it has surprisingly been found that compounds having the formulae (I)

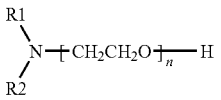

wherein R1 and R2 are, independently, a hydrocarbyl group having 1-22 C-atoms, and n is on average above 15, preferably above 20, and less than 100, preferably less than 80, more preferably less than 60, even more preferably less than 50, still more preferably less than 40, and most preferably less than 35; and (II)

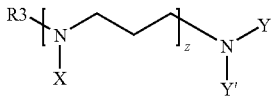

wherein R3 is a hydrocarbyl group having 8-22, preferably 12-22, and most preferably 16-22 carbon atoms; z is a number 1-3, preferably 1-2, and most preferably 1; X, Y and Y' are, independently, an alkyl group with 1-4 carbon atoms, preferably methyl, or the group $-(EO)_sH$, wherein EO is an ethyleneoxy unit and s is on average 5-50, preferably 7-50, more preferably 9-45, even more preferably 9-40, and most preferably 11-35, and the sum of all s is on average 15 or more, preferably 20 or more, and less than 100, preferably less than 80, more preferably less than 60, even more preferably less than 50, still more preferably less than 40, and most preferably less than 35; provided that at least one of X, Y and Y' is a group $-(EO)_sH$; are very efficient collectors for removing slime from potash ores.

Thus the invention pertains to a method for flotating slimes from potash ores by using ethoxylated fatty amines from the group having formulae (I) and (II) as collectors.

In a first embodiment the invention relates to the process wherein compounds of formula (I) are used, while in a second embodiment of the invention compounds of formula (II) are used.

One preferred embodiment is a method where compounds according to formula (I), wherein R1 and R2 are, independently, a hydrocarbyl group having 8-22 carbon atoms and n has the value stated above, are used as collectors.

Another preferred embodiment uses compounds where R1 is a hydrocarbyl group having 8-22 carbon atoms, R2 is a hydrocarbyl group having 1-4, preferably 1-2, carbon atoms, or a benzyl group, and n has the value stated above.

Still another preferred embodiment uses compounds according to formula (II) wherein X, Y, and Y' are the group $-(EO)_sH$, and wherein R3, EO, s, and the sum of all s are as defined above.

By using the new collectors it is possible to achieve better recovery of water insolubles (slime), and the recovery of sylvite preferably is not adversely affected. More preferably, sylvite recovery is increased when a process of the invention is compared with a process wherein a collector of the prior art is used.

The resulting sylvite-containing bottom product will normally be further purified by a second flotation step, wherein the sylvite is floated.

In a further embodiment the present invention also relates to the process where a first treatment in accordance with the invention is followed by a further step which comprises a flotation of sylvite using another collector. This other collector is preferably a fatty amine.

The present invention is further illustrated by the following examples.

EXAMPLES

General Experimental

Flotation Procedure

Method

In practising the invention, the potash ore is crushed to a desirable flotation size and scrubbed in water that is saturated with dissolved potash ore from the actual ore deposit. The pulp is then charged to a flotation machine and diluted to an appropriate concentration. The machine is started and the required amount of a flocculating polymer is added as a 0.1 to 0.5% water solution; 10 g/t polyacrylamide is used in the examples. The collector diluted in water is then added and the pulp is conditioned for a while. The collector is tested at different dosage levels. The air is turned on and the resulting froth containing the slimes (water insolubles) is skimmed off as tailing.

The cell product (non-flotated), also known as bottom product, contains the concentrated potash ore ready to be processed further.

Samples of the froth fraction or slime product and the cell product are dried and analysed for KCl and water insolubles (W.I.) present in both fractions. The material balance, i.e recovery of W.I. and KCl, is calculated for the evaluation of results. The content of W.I. and KCl in the flotation feed (the ore sample that was flotated) is calculated as the sum of the found content of both the slime product and the cell product for each test. This differs to some extent when compared with the overall analysis, which can be explained as small variations in the ore sample and variations between the analyses. The results of the tests are presented in the following tables.

In the slime product the content and recovery of KCl should be low and the W.I. content and recovery should be high. If this condition is met, it means that the flotation is efficient and selective, and the losses of the valuable mineral KCl are low. The cell product should contain a low grade of W.I. The selectivity index (Recovery KCl/Recovery W.I.) is calculated to illustrate the selectivity, and this value should be low. All percentages presented are percentages by weight.

Example 1

In this example slime is flotated from a potash ore comprising on average 34.6% by weight (% w/w) of KCl and on average 4.3% w/w of water insolubles (W.I.) (see Table 1B) using secondary hydrogenated di(tallow alkyl) amine that has been ethoxylated with 30 moles of EO as slime collector, as compared to flotation using primary hydrogenated mono(tallow alkyl) amine that has been ethoxylated with 30 moles of EO.

Polyacrylic amide is present as flocculant in an amount of 10 g/1000 kg. The content of KCl and W.I. in the slime product and in the cell product was determined. From these values and the weight recovery, the total content of KCl and W.I. in the ore sample used in the flotation was calculated (see Table 1B). Using this data the recovery of KCl and W.I. in the slime product, determining the selectivity index for the slime product, was then calculated for all flotation experiments.

TABLE 1A

| Collector dosage, g/1000 kg of ore | Foam product of Slime Flotation: Weight Recovery, % | Content, % KCl | Content, % W.I. | Recovery, % KCl | Recovery, % W.I. | $K_{selectivity}$ $Rec_{KCl}/Rec_{W.I.}$ | Cell product Content, % KCl | Cell product Content, % W.I. |
|---|---|---|---|---|---|---|---|---|
| Secondary hydrogenated di(tallow alkyl) amine (30 EO) | | | | | | | | |
| 5 | 4.2 | 20.1 | 40.0 | 2.4 | 38.1 | 0.063 | 35.1 | 2.8 |
| 10 | 5.0 | 16.0 | 43.8 | 2.3 | 50.7 | 0.045 | 35.9 | 2.2 |
| 15 | 5.1 | 15.2 | 44.7 | 2.2 | 53.2 | 0.041 | 35.8 | 2.1 |
| 20 | 5.0 | 14.3 | 46.8 | 2.1 | 55.0 | 0.038 | 35.9 | 2.0 |
| Primary hydrogenated mono(tallow alkyl) amine (30 EO) (Comparison) | | | | | | | | |
| 5 | 4.0 | 23.2 | 38.2 | 2.7 | 34.8 | 0.078 | 34.9 | 3.0 |
| 10 | 4.6 | 20.1 | 42.1 | 2.7 | 45.2 | 0.060 | 35.3 | 2.5 |
| 15 | 4.8 | 18.3 | 44.2 | 2.5 | 49.4 | 0.051 | 35.5 | 2.3 |
| 20 | 5.0 | 17.0 | 45.9 | 2.5 | 52.2 | 0.048 | 35.5 | 2.2 |

TABLE 1B

| Ore sample, calculated content (%) | |
|---|---|
| KCl | W.I. |
| Secondary hydrogenated di(tallow alkyl) amine (30 EO) | |
| 34.5 | 4.4 |
| 34.9 | 4.3 |
| 34.7 | 4.3 |
| 34.8 | 4.3 |
| Primary hydrogenated mono(tallow alkyl) amine (30 EO) (Comparison) | |
| 34.4 | 4.3 |
| 34.6 | 4.3 |
| 34.7 | 4.3 |
| 34.5 | 4.4 |

When using the same dosage, the selectivity index was lower for the flotation experiments performed with the ethoxylated secondary hydrogenated di(tallow alkyl) amine (30 EO) according to the invention than for the ethoxylated primary amine that was used as an example of the prior art. This means that the product according to the invention is more efficient than the comparison compound in flotating away the slime product from the potash ore without giving rise to large losses of KCl.

Example 2

In this example slime is flotated from a potash ore comprising on average 30.4% by weight (% w/w) of KCl and on average 4.3% w/w of water insolubles (W.I.) (see Table 2B) using secondary hydrogenated di(tallow alkyl) amine that has been ethoxylated with 30, 50, and 55 moles of EO as slime collector, as compared to flotation using primary hydrogenated mono(tallow alkyl) amine that has been ethoxylated with 5 and 6 moles of EO and to secondary hydrogenated di(tallow alkyl) amine that has been ethoxylated with 5 and 6 moles of EO.

Polyacrylic amide is present as flocculant in an amount of 10 g/1000 kg. The selectivity index for the slime product was calculated for all flotation experiments as described in Example 1.

TABLE 2A

| Collector dosage, g/1000 kg of ore | Foam product of Slime Flotation: Weight Recovery, % | Content, % KCl | Content, % W.I. | Recovery, % KCl | Recovery, % W.I. | $K_{selectivity}$ $Rec_{KCl}/Rec_{W.I.}$ | Cell product Content, % KCl (calc.) | Cell product Content, % W.I. |
|---|---|---|---|---|---|---|---|---|
| Secondary hydrogenated di(tallow alkyl) amine (30 EO) | | | | | | | | |
| 5 | 5.3 | 21.0 | 29.8 | 3.7 | 36.7 | 0.101 | 31.0 | 2.9 |
| 10 | 6.5 | 21.7 | 30.5 | 4.6 | 46.1 | 0.100 | 31.3 | 2.5 |
| 20 | 8.0 | 22.0 | 30.8 | 5.8 | 57.3 | 0.101 | 31.1 | 2.0 |
| 30 | 8.7 | 22.1 | 32.0 | 6.3 | 64.7 | 0.097 | 31.3 | 1.7 |
| Secondary hydrogenated di(tallow alkyl) amine (50 EO) | | | | | | | | |
| 5 | 5.3 | 20.9 | 30.0 | 3.6 | 37.0 | 0.097 | 31.3 | 2.9 |
| 10 | 6.5 | 21.0 | 30.4 | 4.5 | 46.0 | 0.098 | 31.0 | 2.5 |
| 20 | 7.9 | 21.1 | 31.0 | 5.5 | 57.0 | 0.096 | 31.1 | 2.0 |
| 30 | 8.5 | 21.5 | 32.7 | 6.0 | 64.6 | 0.093 | 31.3 | 1.7 |
| Secondary hydrogenated di(tallow alkyl) amine (55 EO) | | | | | | | | |
| 5 | 5.2 | 20.5 | 30.1 | 3.5 | 36.4 | 0.096 | 31.0 | 2.9 |
| 10 | 6.6 | 20.8 | 30.6 | 4.5 | 47.0 | 0.096 | 31.2 | 2.4 |
| 20 | 7.9 | 21.0 | 31.0 | 5.5 | 57.0 | 0.096 | 31.0 | 2.0 |
| 30 | 8.4 | 21.5 | 32.8 | 5.9 | 64.1 | 0.092 | 31.5 | 1.7 |
| Primary hydrogenated mono(tallow alkyl) amine (5 EO) (Comparison) | | | | | | | | |
| 10 | 3.5 | 38.2 | 22.1 | 4.4 | 18.0 | 0.244 | 30.1 | 3.7 |
| 20 | 5.9 | 36.9 | 23.0 | 7.2 | 31.6 | 0.228 | 29.8 | 3.1 |
| 30 | 7.0 | 35.5 | 25.3 | 8.2 | 41.2 | 0.199 | 29.9 | 2.7 |
| Primary hydrogenated mono(tallow alkyl) amine (6 EO) (Comparison) | | | | | | | | |
| 10 | 3.9 | 35.0 | 23.7 | 4.5 | 21.5 | 0.209 | 30.1 | 3.5 |
| 20 | 6.0 | 34.2 | 26.1 | 6.8 | 36.4 | 0.187 | 29.9 | 2.9 |
| 30 | 7.1 | 33.1 | 26.8 | 7.7 | 44.3 | 0.174 | 30.3 | 2.6 |
| Primary hydrogenated mono(tallow alkyl) amine (50 EO) (Comparison) | | | | | | | | |
| 5 | 5.1 | 23.0 | 30.0 | 3.9 | 35.6 | 0.110 | 30.5 | 2.9 |
| 10 | 6.3 | 23.1 | 30.1 | 4.8 | 44.1 | 0.109 | 30.8 | 2.6 |
| 20 | 8.0 | 23.6 | 31.1 | 6.2 | 57.9 | 0.107 | 31.1 | 2.0 |
| 30 | 8.4 | 23.4 | 32.4 | 6.5 | 63.3 | 0.103 | 30.9 | 1.7 |
| Secondary hydrogenated di(tallow alkyl) amine (5 EO) (Comparison) | | | | | | | | |
| 10 | 2.5 | 33.2 | 12.1 | 2.7 | 7.0 | 0.386 | 30.7 | 4.1 |
| 20 | 3.6 | 34.8 | 13.0 | 4.1 | 10.9 | 0.376 | 30.4 | 4.0 |
| 30 | 4.3 | 35.9 | 15.3 | 5.1 | 15.3 | 0.333 | 30.0 | 3.8 |
| Secondary hydrogenated di(tallow alkyl) amine (6 EO) (Comparison) | | | | | | | | |
| 10 | 3.2 | 26.8 | 17.0 | 2.8 | 12.7 | 0.220 | 30.8 | 3.9 |
| 20 | 4.3 | 25.8 | 18.9 | 3.6 | 18.9 | 0.190 | 31.0 | 3.6 |
| 30 | 4.8 | 26.0 | 19.0 | 4.1 | 21.2 | 0.193 | 30.7 | 3.6 |

TABLE 2B

| Ore sample, calculated content (%) KCl | W.I. |
|---|---|
| Secondary hydrogenated di(tallow alkyl) amine (30 EO) | |
| 30.1 | 4.3 |
| 30.7 | 4.3 |
| 30.3 | 4.3 |
| 30.5 | 4.3 |
| Secondary hydrogenated di(tallow alkyl) amine (50 EO) | |
| 30.8 | 4.3 |
| 30.3 | 4.3 |
| 30.3 | 4.3 |

TABLE 2B-continued

| Ore sample, calculated content (%) KCl | W.I. |
|---|---|
| 30.5 | 4.3 |
| Secondary hydrogenated di(tallow alkyl) amine (55 EO) | |
| 30.5 | 4.3 |
| 30.5 | 4.3 |
| 30.2 | 4.3 |
| 30.6 | 4.3 |
| Primary hydrogenated mono(tallow alkyl) amine (5 EO) (Comparison) | |
| 30.4 | 4.3 |
| 30.2 | 4.3 |

TABLE 2B-continued

| Ore sample, calculated content (%) | |
|---|---|
| KCl | W.I. |
| 30.3 | 4.3 |
| Primary hydrogenated mono(tallow alkyl) amine (6 EO) (Comparison) | |
| 30.3 | 4.3 |
| 30.2 | 4.3 |
| 30.5 | 4.3 |
| Primary hydrogenated mono(tallow alkyl) amine (50 EO) (Comparison) | |
| 30.1 | 4.3 |
| 30.3 | 4.3 |
| 30.5 | 4.3 |
| 30.2 | 4.3 |
| Secondary hydrogenated di(tallow alkyl) amine (5 EO) (Comparison) | |
| 30.7 | 4.3 |
| 30.6 | 4.3 |
| 30.3 | 4.3 |
| Secondary hydrogenated di(tallow alkyl) amine (6 EO) (Comparison) | |
| 30.6 | 4.3 |

TABLE 2B-continued

| Ore sample, calculated content (%) | |
|---|---|
| KCl | W.I. |
| 30.8 | 4.3 |
| 30.4 | 4.3 |

When using the same dosage, the selectivity index was lower for the flotation experiments performed with the ethoxylated secondary hydrogenated di(tallow alkyl) amine (30, 50, and 55 EO) according to the invention than for the comparative examples using ethoxylated primary and secondary amines of the prior art. This means that the product according to the invention is more efficient than the comparison compounds in flotating away the slime product from the potash ore without giving rise to large losses of KCl.

Example 3

In this example slime is flotated from a potash ore comprising on average 31.9% w/w of KCl and on average 3.2% w/w of water insolubles (W.I.) (see Table 3B), using ethoxylated alkyl 1,3-propylenediamines with different amounts of EO as slime collectors. Polyacrylic amide is present as flocculant in an amount of 10 g/1000 kg. The selectivity index for the slime product was calculated for all flotation experiments as described in Example 1.

TABLE 3A

| Collector | Foam product of slime flotation | | | | | | | |
|---|---|---|---|---|---|---|---|---|
| Dosage, g/1000 kg of | Weight % | Content, % | | Recovery, % | | Selectivity Index | Cell product Content, % | |
| ore | Recovery | KCl | W.I. | KCl | W.I. | $Rec_{KCl}/Rec_{W.I.}$ | KCl | W.I. |
| Tallow alkyl 1,3-propylenediamine EO = 20 | | | | | | | | |
| 5 | 4.4 | 24.1 | 40.0 | 3.3 | 54.9 | 0.060 | 32.3 | 1.5 |
| 10 | 4.9 | 27.2 | 39.3 | 4.2 | 60.2 | 0.070 | 32.1 | 1.3 |
| 15 | 5.1 | 25.6 | 39.2 | 4.1 | 63.0 | 0.065 | 32.3 | 1.2 |
| 20 | 5.4 | 25.3 | 38.6 | 4.3 | 65.2 | 0.066 | 32.3 | 1.2 |
| Tallow alkyl 1,3-propylenediamine EO = 25 | | | | | | | | |
| 5 | 5.4 | 24.0 | 34.8 | 4.0 | 58.3 | 0.069 | 32.3 | 1.4 |
| 10 | 5.4 | 21.3 | 37.4 | 3.6 | 63.4 | 0.057 | 32.5 | 1.2 |
| 15 | 5.6 | 20.6 | 37.2 | 3.6 | 64.9 | 0.055 | 32.7 | 1.2 |
| 20 | 5.9 | 19.1 | 36.0 | 3.5 | 66.2 | 0.053 | 32.7 | 1.2 |
| Tallow alkyl 1,3-propylenediamine EO = 30 | | | | | | | | |
| 5 | 4.4 | 21.1 | 38.5 | 2.9 | 53.1 | 0.055 | 32.4 | 1.6 |
| 10 | 5.2 | 18.9 | 36.8 | 3.1 | 60.0 | 0.052 | 32.6 | 1.4 |
| 15 | 5.3 | 18.7 | 38.2 | 3.1 | 62.7 | 0.049 | 32.7 | 1.3 |
| 20 | 5.9 | 18.0 | 35.1 | 3.3 | 64.7 | 0.051 | 32.8 | 1.2 |
| Tallow alkyl 1,3-propylenediamine EO = 35 | | | | | | | | |
| 5 | 4.3 | 23.1 | 39.0 | 3.1 | 52.7 | 0.059 | 32.4 | 1.6 |
| 10 | 5.5 | 21.4 | 34.3 | 3.7 | 59.3 | 0.062 | 32.5 | 1.4 |
| 15 | 5.6 | 20.4 | 35.8 | 3.6 | 62.2 | 0.058 | 32.6 | 1.3 |
| 20 | 5.9 | 17.2 | 34.2 | 3.2 | 62.7 | 0.051 | 32.9 | 1.3 |
| Oleylamine EO 25; Comparison | | | | | | | | |
| 5 | 4.9 | 27.5 | 34.2 | 4.3 | 52.6 | 0.082 | 32.1 | 1.6 |
| 10 | 5.5 | 26.8 | 34.5 | 4.6 | 59.5 | 0.077 | 32.2 | 1.4 |
| 15 | 5.7 | 21.6 | 35.7 | 3.8 | 63.2 | 0.060 | 32.5 | 1.3 |
| 20 | 5.7 | 20.3 | 36.0 | 3.6 | 63.7 | 0.057 | 32.6 | 1.2 |

TABLE 3B

| Ore sample, calculated content (%) | |
|---|---|
| KCl | W.I. |
| Tallow alkyl 1,3-propylenediamine EO = 20 | |
| 31.9 | 3.2 |
| 31.9 | 3.2 |
| 32.0 | 3.2 |
| 31.9 | 3.2 |
| Tallow alkyl 1.3-propylenediamine EO = 25 | |
| 31.9 | 3.2 |
| 31.9 | 3.2 |
| 32.0 | 3.2 |
| 31.9 | 3.2 |
| Tallow alkyl 1.3-propylenediamine EO = 30 | |
| 31.9 | 3.2 |
| 31.9 | 3.2 |
| 31.9 | 3.2 |
| 31.9 | 3.2 |
| Tallow alkyl 1.3-propylenediamine EO = 35 | |
| 32.0 | 3.2 |
| 31.9 | 3.2 |
| 31.9 | 3.2 |
| 31.9 | 3.2 |
| Oleylamine EO 25; Comparison | |
| 31.9 | 3.2 |
| 31.9 | 3.2 |
| 31.9 | 3.2 |
| 31.9 | 3.2 |

When using the same dosage, the selectivity index was lower for the flotation experiments performed with the tallow alkyl 1,3-propylenediamine according to the invention than for the primary ethoxylated amine that was used as an example of the prior art. This means that the product according to the invention is more efficient than the comparison compound in flotating away the slime product from the potash ore without giving rise to large losses of KCl.

The invention claimed is:

1. A flotation method for removal of slimes from potash ores wherein said method comprises utilizing at least one collector selected from the group of ethoxylated fatty amines having the formulae (I)

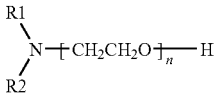

wherein R1 and R2 are, independently, a hydrocarbyl group having 1-22 C-atoms, and n is on average above 15, and less than 100; and/or (II)

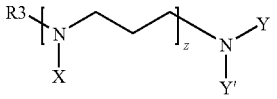

wherein R3 is a hydrocarbyl group having 8-22 carbon atoms; z is a number of from 1-3; X, Y and Y' are, independently, an alkyl group with 1-4 carbon atoms, or the group $-(EO)_sH$, where EO is an ethyleneoxy unit and s is on average 5-50, wherein the sum of all s is on average 15 or more and less than 100; provided that at least one of X, Y and Y' is a group $-(EO)_sH$.

2. A method according to claim 1 wherein the ethoxylated fatty amine has the formula (I) wherein R1 and R2 are, independently, a hydrocarbyl group having 8-22 carbon atoms, and n and the sum of all n are as defined in claim 1.

3. A method according to claim 1 wherein the ethoxylated fatty amine has the formula (I) wherein R1 is a hydrocarbyl group having 8-22 carbon atoms, R2 is a hydrocarbyl group having 1-4, carbon atoms, or a benzyl group, and n and the sum of all n are as defined in claim 1.

4. A method according to claim 1 wherein the ethoxylated fatty amine has the formula (II) wherein X, Y, and Y' are the group $-(EO)_sH$, wherein R3, EO, s, and the sum of all s are as defined in claim 1.

5. A method according to claim 1 wherein the removal of slime is followed by a further step which comprises a flotation of sylvite using another collector.

6. A method according to claim 5 wherein said collector in the further step is a fatty amine.

7. The method of claim 1 wherein n is an integer of greater than 20 and less than 80.

8. The method of claim 1 wherein n is an integer of greater than 20 and less than 60.

9. The method of claim 1 wherein n is an integer of greater than 20 and less than 50.

10. The method of claim 1 wherein n is an integer of greater than 20 and less than 40.

11. The method of claim 1 wherein n is an integer of greater than 20 and less than 35.

12. The method of claim 1 wherein z is a number of from 1-2, and X, Y and Y' are each methyl provided at least one of X, Y and Y' is $-(EO)_sH$.

13. The method of claim 1 wherein s is on average 7-50, and the sum of all s is on average or more, and less than 100.

14. The method of claim 1 wherein s is on average 9-45 and the sum of all s is on average 20 or more, and less than 80.

15. The method of claim 1 wherein s is on average 9-40 and the sum of all s is on average or more, and less than 60.

16. The method of claim 1 wherein s is on average 11-35, and wherein the sum of all s is on average 20 or more, and less than 50.

17. The method of claim 1 wherein s is on average 11-35, and wherein the sum of all s is on average 20 or more, and less than 35.

* * * * *